US007654731B2

(12) United States Patent
Goeller

(10) Patent No.: US 7,654,731 B2
(45) Date of Patent: Feb. 2, 2010

(54) TIMEPIECE COMPRISING AN IMPROVED TIME-SETTING DEVICE

(75) Inventor: Eric Goeller, Les Hôpitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 246 days.

(21) Appl. No.: 11/755,863

(22) Filed: May 31, 2007

(65) Prior Publication Data

US 2008/0259741 A1 Oct. 23, 2008

(30) Foreign Application Priority Data

May 31, 2006 (EP) ..... 06114759

(51) Int. Cl.
*G04B 27/02* (2006.01)

(52) U.S. Cl. ..... 368/190

(58) Field of Classification Search ..... 368/190–199
See application file for complete search history.

(56) References Cited

U.S. PATENT DOCUMENTS 4,262,354 A * 4/1981 Sakamoto ..... 368/185
5,504,721 A * 4/1996 Calabrese ..... 368/185
5,963,511 A * 10/1999 Huter ..... 368/196
6,711,099 B1 * 3/2004 Mock et al. ..... 368/31
7,134,783 B2 * 11/2006 Schmiedchen et al. ..... 368/190

FOREIGN PATENT DOCUMENTS

| | | |
|---|---|---|
| CH | 539 287 | 3/1973 |
| EP | 0 640 892 A1 | 3/1995 |
| GB | 1241936 | 8/1971 |
| WO | 02/077721 A1 | 10/2002 |

OTHER PUBLICATIONS

European Search Report issued in corresponding application No. EP 06 11 4759, completed Mar. 1, 2007.

* cited by examiner

*Primary Examiner*—Edwin A. Leon
(74) *Attorney, Agent, or Firm*—Griffin & Szipl, P.C.

(57) ABSTRACT

According to the invention, the time-setting device (18) of the timepiece includes a time-setting lever (62) which carries a coupling device (64) and the pivoting of which is controlled between an uncoupled position and a coupled position corresponding to the time-setting position of the winding stem (22). The coupling device (64) includes an exit pinion (78) which, in the coupled position, meshes with a minute wheel (16), and a plate (90) which is pivotably mounted on the time-setting lever (62) and which is provided with first and second reversion wheels (94, 96) of parallel axes (A8, A9) meshing with each other. An intermediate wheel (60), which is driven in rotation by the winding stem (22) in the time-setting position, meshes with the first reverser wheel (94).

9 Claims, 3 Drawing Sheets

TIMEPIECE COMPRISING AN IMPROVED TIME-SETTING DEVICE

This application claims priority from European Patent Application No. 06114759.1 filed May 31, 2006, the entire disclosure of which is incorporated herein by reference.

FIELD OF THE INVENTION

The invention concerns a timepiece comprising an improved time-setting device.

The invention concerns more specifically a timepiece comprising a motion work which, via a minute wheel, drives analog display means in rotation, and a time-setting device including a winding stem which, when it occupies a time-setting position, controls the rotation of the minute wheel in order to carry out a time-setting operation.

BACKGROUND OF THE INVENTION

In a timepiece fitted with a movement comprising a large number of complications, it is practical for time-setting to be carried out in only one direction of rotation of the winding stem, preferably the clockwise direction. In fact, time-setting in the opposite direction can cause unanticipated movements of parts, for example in a strike mechanism and especially in a perpetual calendar mechanism, which often leads to the deterioration of some elements of the movement. As the user still does not have a good understanding how the timepiece and its complications work, it regularly happens that ill-advised manipulations, such as time-setting in the opposite direction, are carried out despite warnings, which means that the timepiece has to be returned to after-sales service.

It is also known from GB 1241936 a time-setting mechanism which does not have any winding wheel and comprising a rotatable stem, a section of which having a plane surface parallel to the axis of the stem, coupling means mounted on said section, said coupling means being rotatably connected to the stem and able to move between a direct coupling position with the minute wheel and an incoupled position from said wheel such that there is no intermediate wheel train between the coupling means and the minute wheel.

It is an object of the present invention to overcome these drawbacks by proposing a timepiece that enables the user to rotate the winding stem in both directions, in the time-setting position, without any risk of damaging the movement.

SUMMARY OF THE INVENTION

The invention therefore proposes a timepiece of the type described above, characterized in that the time-setting device includes a time-setting lever which carries a coupling device and whose pivoting is controlled by the winding stem, between an uncoupled position and a coupled position corresponding to the time-setting position of the winding stem, in that the coupling device comprises an exit pinion which, in the coupled position, meshes with the minute wheel, and a plate that is pivotably mounted on the time-setting lever and which is provided with first and second reverser wheels with parallel axes meshing with each other, in that an intermediate wheel, which is driven in rotation by the winding stem in the time-setting position, meshes with the first reverser wheel, and in that, in the coupled position:

in a first direction of rotation of the winding stem, the plate occupies a first angular position in which the first reverser wheel meshes with a toothing arranged on the arbor of the exit pinion such that the minute wheel is driven in a determined direction of rotation called the time-setting direction, and in a second direction of rotation of the winding stem, the plate occupies a second angular position in which the second reverser wheel meshes with a toothing arranged on the arbor of the exit pinion such that the minute wheel is driven in the time-setting direction.

The timepiece according to the invention enables the user to set the time without worrying about the direction in which he has to rotate the winding stem. In whichever direction he rotates the winding stem, he always rotates the display means in the same direction, which removes the risk of a manipulation error during time-setting and makes the timepiece easier to use.

According to another feature of the invention, the toothing arranged on the arbor of the exit pinion is formed by an entry pinion which is offset axially relative to the exit pinion, which facilitates arrangement of the time-setting device in the timepiece by minimising its space requirement.

Advantageously, the pivoting plate extends generally in a plane parallel to the time-setting lever, the reverser wheels are arranged on a bottom face of the pivoting plate, on the opposite side to the time-setting lever, and the plate is pivotably mounted on the time-setting lever by means of a pivot arranged on the top face of the plate. The pivot extends axially through a hole made in the time-setting lever so that the top axial end thereof projects above the top face of the time-setting lever, the top axial end of the pivot includes an annular groove, and a fork is secured to the top face of the time-setting lever such that the annular groove receives the arms of the fork to hold the plate axially on the time-setting lever. A particularly simple pivoting system is thereby obtained with a minimum number of parts. The use of the fork allows the plate to be pivotably secured without using additional screws or parts of complex shape, which facilitates assembly and dismantling of the coupling device.

Preferably, the pivoting axis of the time-setting lever is identical to the axis of rotation of the intermediate wheel which guarantees that the position of the first reverser wheel is properly adjusted relative to the intermediate wheel.

According to another feature of the invention, the winding stem includes a coaxial time-setting pinion and, in the time-setting position, the time-setting pinion is connected in rotation to the winding stem and it meshes with a time-setting wheel meshing with the intermediate wheel. The winding stem comprises a sliding coaxial pinion and, in the time-setting position, the sliding pinion meshes via an axial toothing with slots with a complementary toothing to the time-setting pinion in order to connect the time-setting pinion and the winding stem in rotation. This time-setting mechanism, in particular via the user of the axial slotted toothing, allows a higher drive couple to be passed to the minute wheel, while minimising wear on the teeth used for meshing the sliding pinion and the time-setting pinion. The risk of slipping between the sliding pinion and the time-setting pinion is removed.

Preferably, the time-setting device comprises a pivoting pull-out piece which is hinged on the winding stem such that the axial sliding of the winding stem towards the time-setting position controls the pivoting of the pull-out piece towards a time-setting position. The pivoting of the pull-out piece towards its time-setting position controls the sliding of the sliding pinion towards its time-setting position via a drive lever cooperating with the pull-out piece and with the sliding pinion, and it controls the pivoting of the time-setting lever towards its coupled position. This control system has the advantage of being reliable and easy to assemble.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE ILLUSTRATIVE EMBODIMENTS

In the following description, an orthogonal marking V, L, T, respectively defining the vertical, longitudinal and transverse orientations, will be used in a non-limiting manner.

In the annexed Figures, the teeth of the gear trains are not systematically shown, in order to simplify the drawings and facilitate comprehension of the Figures.

Figure 1:
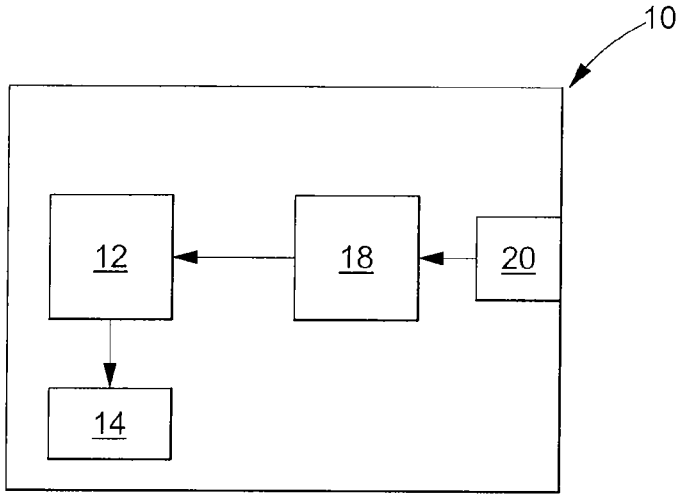
FIG. 1 is a flowchart which shows the main elements of the timepiece according to the invention.

FIG. 1 shows a timepiece 10 in the form of a flowchart. Timepiece 10 is preferably formed by a wristwatch fitted with a mechanical watch movement that is provided with a motion work 12 driving in rotation analog display means 14, such as hands, via a minute wheel 16, shown in particular in FIG. 2.

Timepiece 10 also comprises a time-setting device 18 that cooperates with motion work 12, by coupling with the minute wheel 16 in order to alter the time indicated by display means 14. Time-setting device 18 is controlled by a manual control member such as a winding crown 20.

Figure 2:
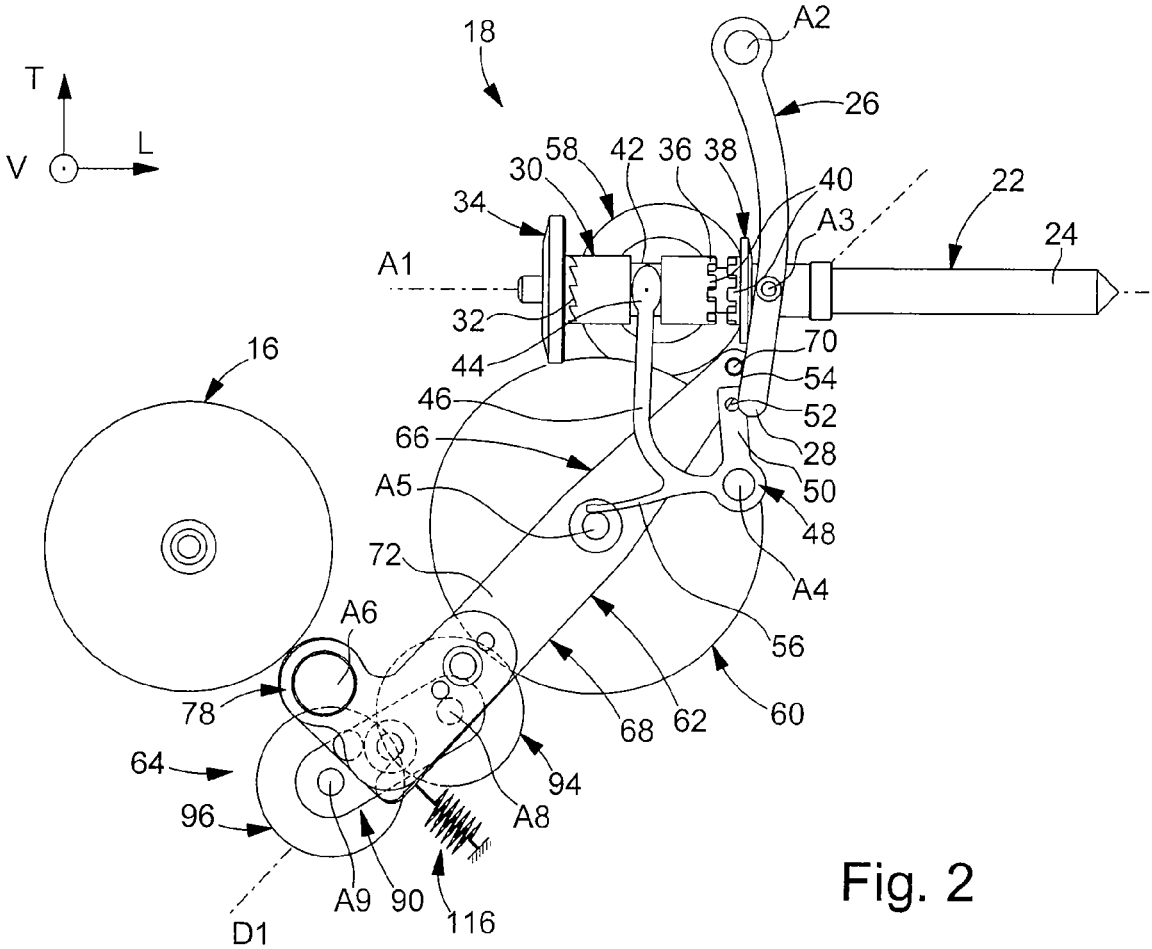
FIG. 2 is a top view which shows the time-setting device of the timepiece of FIG. 1 in the winding position.
Figure 3:
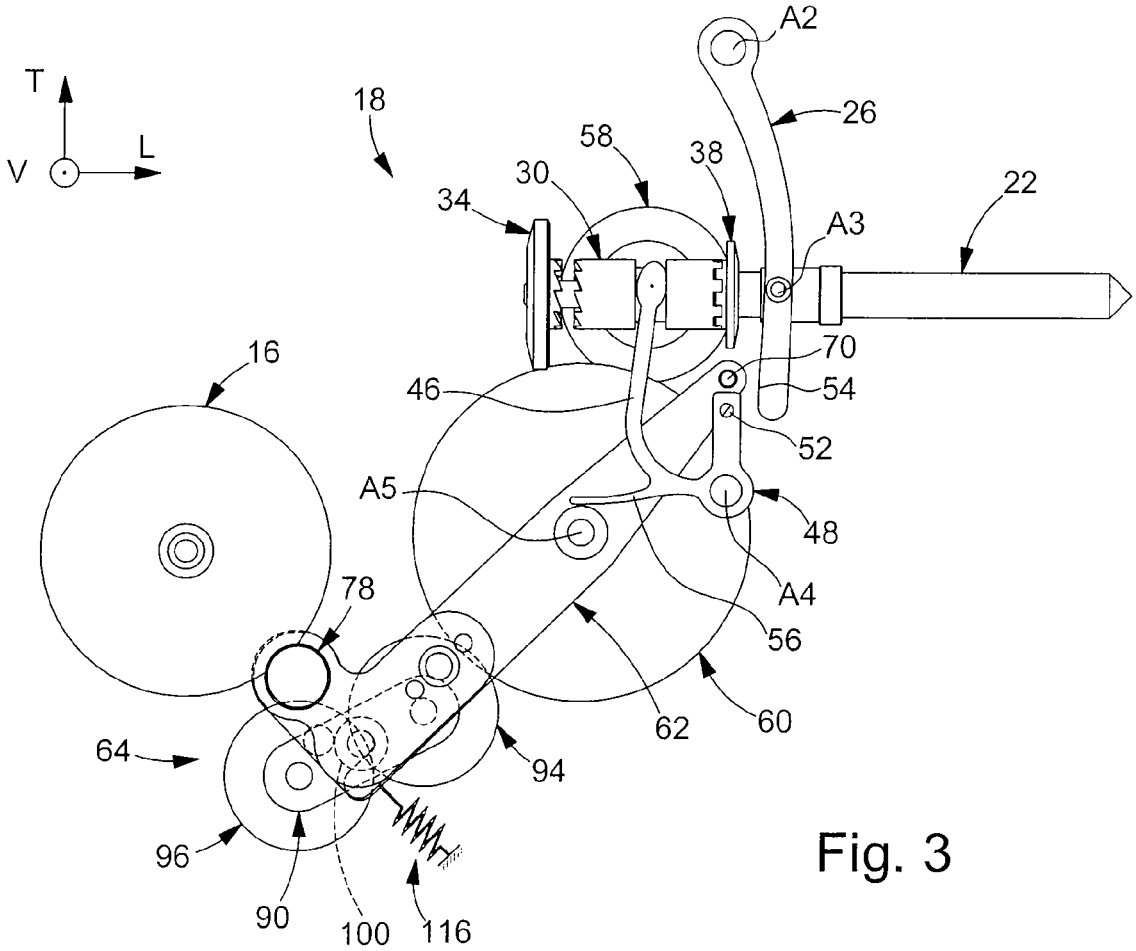
FIG. 3 is a similar view to that of FIG. 2 which shows the time-setting device in the time-setting position and the coupling device fitted with the time-setting device when it occupies a first angular position.
Figure 4:
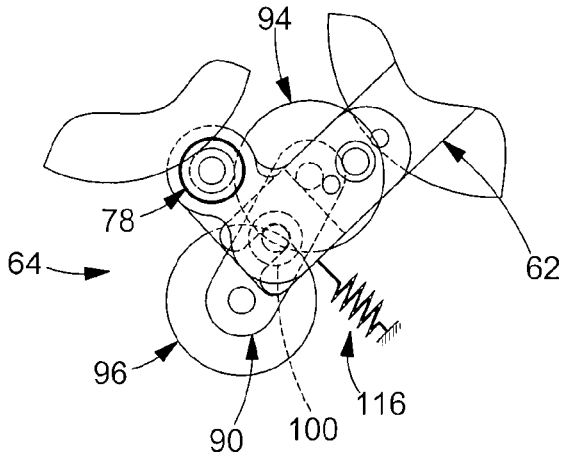
FIG. 4 is a view of one detail of FIG. 3 which shows the coupling device in a second angular position.
Figure 5:
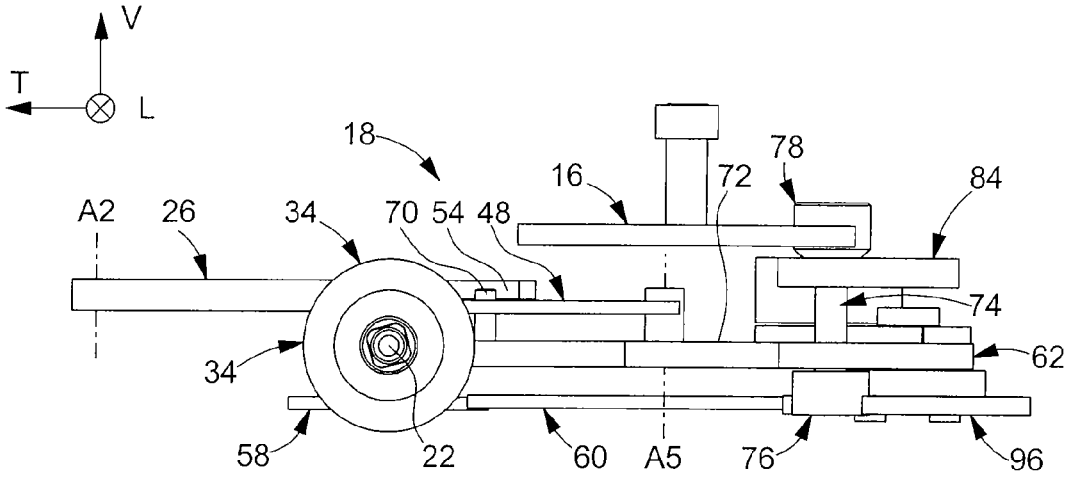
FIG. 5 is a side view which shows the time-setting device of FIG. 3.

Time-setting device 18 is shown in more detail in FIGS. 2 to 4. It comprises a winding stem 22 that slides along a longitudinal axis A1 orientated, in a non-limiting manner, from the interior towards the exterior, which corresponds to an orientation from left to right in FIG. 2. Winding crown 20 is to be secured to the outer axial end 24 of winding stem 22 in order to allow the user, on the one hand, to control rotation of the winding stem 22 about its axis A1 and, on the other hand, to control the axial sliding (A1) of winding stem 22.

Winding stem 22 has at least two distinct axial positions, a neutral position inwards, called the winding position Pr, and a position pulled outwards, called the time-setting position Ph, these two positions Pr and Ph being shown respectively in FIGS. 2 and 3. The function of these two positions will be explained hereafter.

In the following description, the pivoting and rotational axes mentioned are, unless otherwise indicated, substantially vertical, which corresponds to the orientation of the axes of motion work 12.

The pivoting of a pull-out piece 26 is controlled by winding stem 22. The pull-out piece 26 pivots about a fixed arbor A2, on the opposite side to its free end 28, and it includes a mobile articulation pin A3, which is arranged on the winding stem 22 and which is secured to winding stem 22 as the latter slides axially. Articulation pin A3 is arranged here between fixed arbor A2 and the free end of pull-out piece 26.

A sliding pinion 30, which is coaxial and secured in rotation to winding stem 22, is guided by sliding longitudinally on winding stem 22 between a winding position Pr in which its inner end 32 meshes with a winding stem 34 coaxial to winding stem 22, and time-setting position Ph in which its outer end 36 meshes with a time-setting pinion 38 coaxial to winding stem 22. Sliding pinion 30 meshes here with winding pinion 34 via a toothing with unsymmetrical teeth.

Winding pinion 34 and time-setting pinion 38 are mounted to rotate freely on winding stem 22, sliding pinion 30 being used to connect one or other of these two pinions 34, 38 to winding stem 22 in rotation.

According to an advantageous embodiment, sliding pinion 30 meshes with time-setting pinion 38 via an axial slotted toothing, the profile of teeth 40 being substantially rectangular. Each tooth 40 has the overall shape of a cube.

The intermediate section of sliding pinion 30 is provided with an annular peripheral groove 42 which is provided for receiving in an articulated manner the free end 44 of drive finger 46 belonging to a swan-neck shaped drive lever 48. Drive lever 48 pivots about a fixed pin A4 and comprises a control arm 50 fitted with a pin 52 which is drawn elastically to abut against an inner surface 54 of pull-out piece 26, in proximity to the free end 28 of pull-out piece 26. Drive lever 48 here includes a resilient tongue 56, which is kept deformed resiliently against a fixed element in order to draw pin 52 against pull-out piece 26. Thus, when pull-out piece 26 pivots towards the time-setting position Ph, drive lever 48 pivots, which drives sliding pinion 30, by means of drive finger 46, outwards, i.e. towards time-setting position Ph.

Time-setting pinion 38 meshes with a time-setting wheel 58 which here extends in a horizontal plane, underneath winding stem 22. Time-setting wheel 58 meshes with an intermediate wheel 60 with an arbor A5.

According to the embodiment shown here, the fixed element against which resilient tongue 56 abuts is formed by arbor A5 of intermediate wheel 60.

Figure 6:
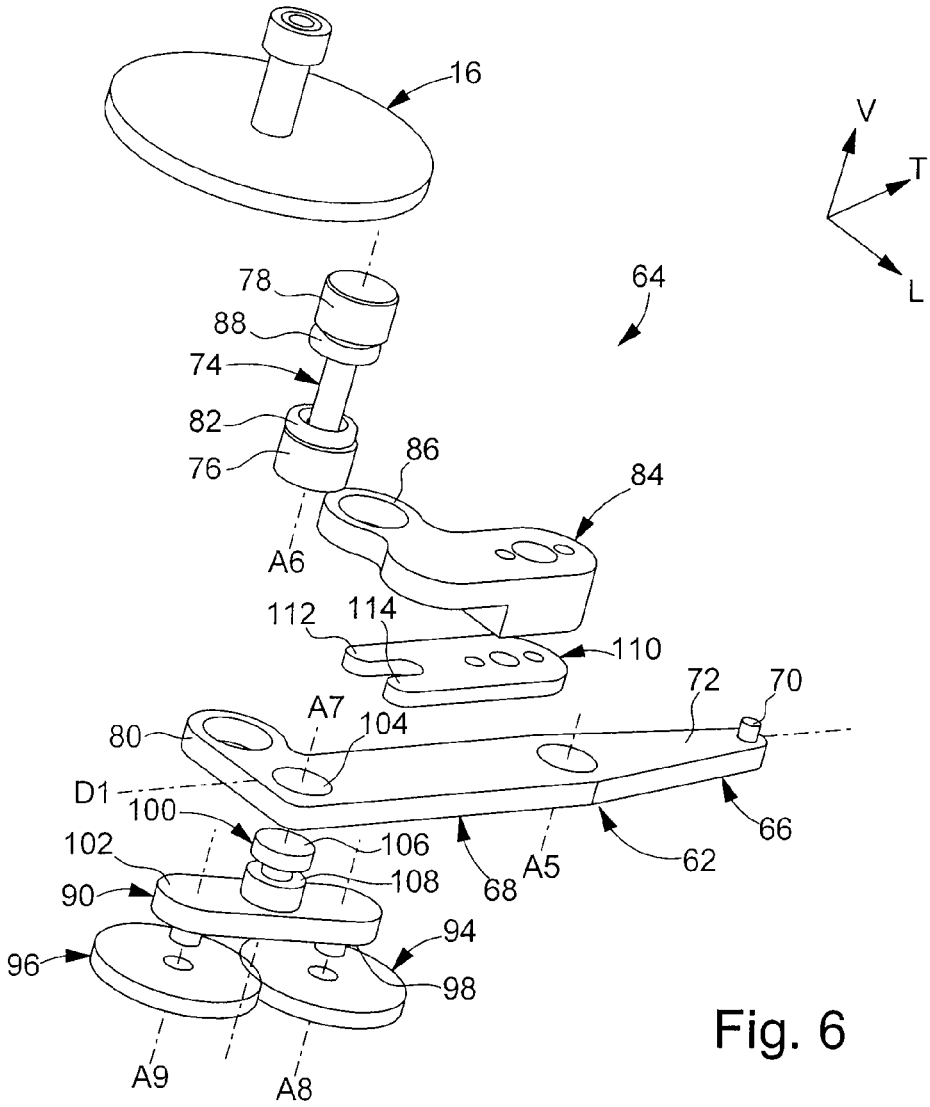
FIG. 6 is an exploded perspective view which shows the coupling device of FIG. 3.

According to the teaching of the invention, time-setting device 18 comprises a time-setting lever 62 which carries a coupling device 64, shown in detail in FIG. 6, and the pivoting of which is controlled about an arbor A5 by winding stem 22, between an uncoupled position Pd and a coupled position Pe respectively corresponding to the winding position Pr and the time-setting position Pr of winding stem 22.

Time-setting lever 62 is here pivotably mounted about arbor A5 of intermediate wheel 60. According to the embodiment shown, it extends overall along a general direction D1 contained within a horizontal plane and it comprises, on either side of its pivoting arbor A5, a first arm 66 which extends on the side of winding stem 22 and a second arm 68 which extends on the side opposite winding stem 22 and which carries coupling device 64 at the free end thereof.

The free end of first arm 66 is fitted here with a pin 70 which is arranged on the top surface 72 of lever 24 and which is drawn resiliently to abut against the inner surface 54 of the free end 28 of pull-out piece 26, when pull-out piece 26 occupies its winding position Pr.

According to an alternative embodiment (not shown), pin 70 can be arranged on an intermediate lever whose pivoting is controlled by pull-out piece 26 and which abuts against time-setting lever 62 to control the pivoting of time-setting lever 62 towards the coupled position Pe.

Coupling device 64 also includes a drive arbor 74 of axis A6 which is provided, at its bottom end, with an entry pinion 76 and, at its top end, with an exit pinion 78 providing for meshing with the minute wheel 16, when time-setting lever 62 is occupying its coupled position Pe. The two pinions 76, 78 are secured in rotation to drive arbor 74.

Drive arbor 74 is mounted to rotate freely on time-setting lever 62. Time-setting lever 62 therefore includes a bottom eyelet 80 that is offset orthogonally relative to the general direction D1 and which extends into the plane of time-setting lever 62 to carry bottom bearing 82 of drive arbor 74. A support piece 84, which includes a top eyelet 86 is secured to the top face 72 of time-setting lever 62 to carry the top bearing 88 of drive arbor 74.

Entry pinion 76 is arranged here underneath bottom eyelet 80 and exit pinion 78 is arranged here above top eyelet 86. The two pinions 76, 78 are thus shifted axially (A6) in relation to each other on drive arbor 74.

Coupling device 64 also includes a plate 90 which is pivotably mounted about an axis A7 on the bottom face 92 of time-setting lever 62 and which is provided with first and second reverser wheels 94, 96 of parallel axes A8, A9 meshing with each other, the first reverser wheel 94 also meshing with intermediate wheel 60.

In the coupled position, along the direction of rotation of intermediate wheel 60, which depends upon the direction of rotation of winding stem 22, plate 90 occupies, either a first angular position in which it is second reverser wheel 96 that meshes with entry pinion 76, which corresponds to the position shown in FIG. 3, or a second angular position in which it is the first reverser wheel 94 that meshes with entry pinion 76, which corresponds to the position shown in FIG. 4.

Entry pinion 76 forms a drive toothing that drives exit pinion 78 in rotation via one or other of reverser wheels 94, 96.

According to an advantageous embodiment, plate 90 extends overall in a plane parallel to time-setting lever 62 and reverser wheels 94, 96 are arranged on the bottom face 98 of plate 90. Plate 90 is pivotably mounted on time-setting lever 62 by means of a pivot 100 arranged on the top face 102. Pivot 100 extends axially (A7) through a hole 104 made in time-setting lever 62 such that the top axial end 106 thereof projects above the top face 72 of lever 62. The top axial end 106 of pivot 100 comprises an annular groove 108 and a fork 110 is fixed to the top face 72 of time-setting lever 62 such that the two arms 112, 114 of fork 110 are received in annular groove 108 of pivot 100 to hold plate 90 axially on time-setting lever 62.

The operation of time-setting device 18 of timepiece 10 according to the invention will now be explained starting from winding position Pr of FIG. 2.

In winding position Pr, sliding pinion 30 secures winding stem 22 to winding pinion 34 in rotation to allow the movement of timepiece 10 to be wound. Time-setting pinion 38 is free to rotate relative to winding stem 22 and time-setting lever 62 occupies its uncoupled position Pd, such that exit pinion 78 is radially removed from minute wheel 16.

When the user wishes to set the time, he grasps winding crown 20 in order to slide longitudinally A1 the winding stem 22 outwards to its time-setting position Ph. By sliding outwards, winding stem 22 causes pull-out piece 26 to pivot, in the anti-clockwise direction looking at FIG. 2.

Since pin 52 of drive lever 48 is drawn to abut against pull-out piece 26 by resilient tongue 56, the pivoting of pull-out piece 26 causes drive lever 48 to pivot, here in the clockwise direction, and drive finger 46 causes sliding pinion 30 to slide longitudinally A1 into its time-setting position Ph in which it meshes with time-setting pinion 38.

Simultaneously, while sliding outwards, winding stem 22 causes time-setting lever 62 to pivot towards its coupled position Pe, via the effect of a resilient element 116, which draws pin 70 against pull-out piece 26.

In the time-setting position Ph and in coupled position Pe, the user can set the time of display means 14 by rotating winding stem 22 about its axis A1 by mean of winding crown 20.

In a first direction of rotation of winding stem 22, time-setting pinion 38 drives intermediate wheel 60, via time-setting wheel 58, for example in the clockwise direction, looking at FIG. 3. The first reverser wheel 94 then rotates in the anti-clockwise direction and it is drawn against entry pinion 76 such that plate 90 occupies its second angular position (FIG. 4). The first reverser wheel 94 then drives exit pinion 78, via entry pinion 76, in the clockwise direction, which drives in minute wheel 16 in rotation in the time-setting direction Sh which is the anti-clockwise direction looking at FIG. 3.

If the user changes the direction of rotation of winding stem 22, time-setting pinion 38 then drives intermediate wheel 60 in the anti-clockwise direction. First reverser wheel 94 then rotates in the clockwise direction and it rolls over intermediate wheel 60 causing plate 90 to pivot to its first angular position in which second reverser wheel 96 is drawn against entry pinion 76. First reverser wheel 94 then drives second reverser wheel 96 in the anti-clockwise direction. Second reverser wheel 96 drives exit pinion 78, via entry pinion 76, in the clockwise direction, which drives minute wheel 16 in the same time-setting direction Sh as before.

Thus, in whichever direction the user rotates winding stem 22, including if he changes direction during the time-setting operation, minute wheel 16 and the analog display member still rotate in the same direction, thus removing any risk of manipulation error.

When the user pushes winding stem 22 back to its winding position Pr, the elements of time-setting device 18 return to their initial pre-time-setting position.

What is claimed is:

1. A timepiece, including:

(a) a motion work which drives in rotation analog display means via a minute wheel; and (b) a time-setting device including a winding stem, which, when occupying a time-setting position controls the rotation of the minute wheel in order to carry out a time-setting operation, (c) wherein the time-setting device includes a time-setting lever that carries a coupling device, and pivoting of the coupling device is controlled by the winding stem between an uncoupled position and a coupled position corresponding to the time-setting position of the winding stem, (d) wherein the coupling device includes (i) an exit pinion which, in the coupled position, meshes with the minute wheel and (ii) a plate that is pivotably mounted on the time-setting lever and that is provided with first and second reverser wheels of parallel axes meshing with each other, (e) wherein an intermediate wheel, which is driven in rotation by the winding stem in the time-setting position, meshes with the first reverser wheel, and (f) wherein, in the coupled position, (i) in a first direction of rotation of the winding stem, the plate occupies a first angular position in which the first reverser wheel meshes with a toothing arranged on an arbor of the exit pinion such that the minute wheel is driven in rotation in a determined direction of rotation called a time-setting direction, and (ii) in a second direction of rotation of the winding stem, the plate occupies a second angular position in which the second reverser wheel meshes with the toothing arranged on the arbor of the exit pinion such that the minute wheel is driven in the time-setting direction.

2. The timepiece according to claim 1, wherein the toothing arranged on the arbor of the exit pinion is formed by an entry pinion which is offset axially relative to the exit pinion.

3. The timepiece according to claim 1, wherein a pivoting axis of the time-setting lever is identical to the axis of rotation of the intermediate wheel.

4. The timepiece according to claim 1, wherein the time-setting device includes a pivoting pull-out piece which is hinged on the winding stem such that the axial sliding of the winding stem towards the time-setting position thereof controls the pivoting of the pull-out piece towards the time-setting position thereof, and the pivoting of the pull-out piece towards the time-setting position thereof controls the pivoting of the time-setting lever towards the coupled position thereof.

5. The timepiece according to claim 1, wherein the plate extends overall in a parallel plane to the time-setting lever, wherein the reverser wheels are arranged on a bottom face of the plate, on the opposite side to the time-setting lever, and wherein the plate is pivotably mounted on the time-setting lever by means of a pivot arranged on a top face of the plate.

6. The timepiece according to claim 5, wherein the pivot extends axially through a hole made in the time-setting lever such that a top axial end of the pivot projects above a top face of the time-setting lever, wherein the top axial end of the pivot includes an annular groove, and wherein a fork is secured to the top face of the time-setting lever such that arms of the fork are accommodated in the annular groove in order to hold the plate axially on the time-setting lever.

7. The timepiece according to claim 1, wherein the winding stem includes a coaxial time-setting pinion and wherein, in the time-setting position, the time-setting pinion is connected to the winding stem in rotation and meshes with a time-setting wheel meshing with the intermediate wheel.

8. The timepiece according to claim 7, wherein the winding stem includes a coaxial sliding pinion and wherein, in the time-setting position, the sliding pinion meshes via a slotted toothing with a complementary toothing of the time-setting pinion so as to connect the time-setting pinion and the winding stem in rotation.

9. The timepiece according to claim 8, wherein the time-setting device includes a pivoting pull-out piece which is hinged on the winding stem such that the axial sliding of the winding stem towards the time-setting position controls the pivoting of the pull-out piece towards a time-setting position, and wherein the pivoting of the pull-out piece towards the time-setting position thereof controls the sliding of the sliding pinion towards the time-setting position thereof via a drive lever cooperating with the sliding pinion.

* * * * *